US007538284B2

(12) United States Patent
Nielsen et al.

(10) Patent No.: US 7,538,284 B2
(45) Date of Patent: May 26, 2009

(54) ELECTRICAL CONTROL PANEL PREFERABLY FOR HEIGHT ADJUSTABLE TABLES

(75) Inventors: Jens Jørgen Nielsen, Broager (DK); Finn Jacobsen, Nordborg (DK); Martin Riis, Nordborg (DK)

(73) Assignee: Linak A/S, Nordborg (DK)

( * ) Notice: Subject to any disclaimer, the term of this patent is extended or adjusted under 35 U.S.C. 154(b) by 0 days.

(21) Appl. No.: 11/790,968

(22) Filed: Apr. 30, 2007

(65) Prior Publication Data

US 2007/0227865 A1 Oct. 4, 2007

Related U.S. Application Data

(63) Continuation of application No. 10/512,989, filed on Dec. 16, 2004, now abandoned.

(51) Int. Cl.

| | |
|---|---|
| ***H01H 9/00*** | (2006.01) |
| ***H01H 13/00*** | (2006.01) |
| ***H01H 19/04*** | (2006.01) |
| ***H01H 19/08*** | (2006.01) |

(52) U.S. Cl. ..... 200/296; 200/61.7

(58) Field of Classification Search ..... 200/296, 200/61.7

See application file for complete search history.

(56) References Cited

U.S. PATENT DOCUMENTS

| | | | | |
|---|---|---|---|---|
| 4,922,064 | A * | 5/1990 | Price et al. | 200/61.7 |
| 6,667,449 | B2 * | 12/2003 | Wecke et al. | 200/61.7 |
| 7,238,900 | B2 * | 7/2007 | Ulfik et al. | 200/61.7 |
| 7,271,358 | B2 * | 9/2007 | Ulfik et al. | 200/61.7 |

* cited by examiner

*Primary Examiner*—Elvin G Enad
*Assistant Examiner*—Lheiren Mae A Anglo
(74) *Attorney, Agent, or Firm*—Dykema Gossett PLLC

(57) ABSTRACT

An electrical operating panel, in particular for height-adjustable tables equipped with actuators or lifting columns driven by an electric motor. The panel has a first part (1) intended for fixed mounting of the panel and a second part (2) with operating keys (19) for activating electrical switches. The two parts are hinged together, and the hinge is formed with a rotary shaft (10) on the no part and a bearing with a cylindrical face (13) on the other part and formed with interengaging projections (16) and depressions (15) such that the second part may assume various angular positions relative to the first part, the force between projections and depressions bearing greater than the necessary operative pressure on the operating keys, but smaller than the force necessary to manually move the second part between the various angular positions. The panel is of simple structure and easy to mount and use. The users may easily set the keyboard part in the desired angular position. Furthermore, the panel yields so that it is not damaged in case of collision with an object.

17 Claims, 6 Drawing Sheets

ELECTRICAL CONTROL PANEL PREFERABLY FOR HEIGHT ADJUSTABLE TABLES

BACKGROUND OF THE INVENTION

1. Field of the Invention

Figure 1:
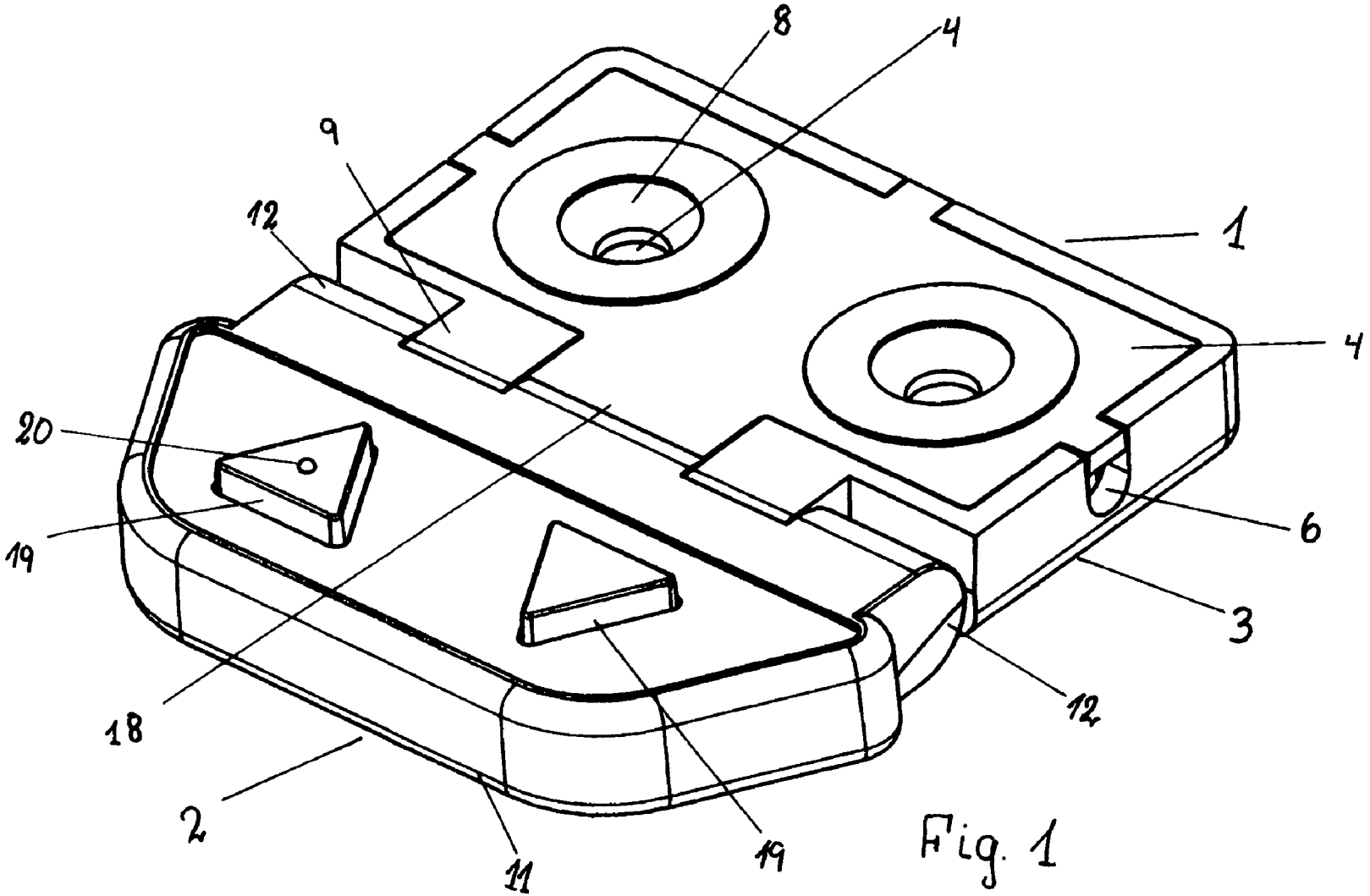

The present invention relates to an electrical control panel, in particular for height adjustable articles of furniture, such as height-adjustable tables equipped with actuators or lifting columns driven by an electric motor, the panel including a mounting part intended for firm fixed mounting of the panel and a keyboard part having operating keys for activating electrical switches, the two parts being hinged together.

2. The Prior Art

Height-adjustable tables equipped with actuators or lifting columns driven by electric motors are adjusted via an operating panel. The arrangement of the operating panel causes problems, however, as it should preferably be easy to operate, and on the other hand it must not be provided at a location where it is liable to be damaged. A position where it protrudes beyond the tabletop is inexpedient, since it is hereby liable to be damaged both during storage, transport and movement. An example of such an operating panel is known from DE 298 18 567 to Vibradorm GmbH, where the keyboard part is arranged removably in the mounting part, but the latter constantly protrudes forwardly of the edge of the table. A position on or mounting in the tabletop has also been found to be inexpedient, since the operating panel quickly gets covered by objects that are left on the table. A solution where the operation takes place via a PC, has not been found to be optimum either; typically, there is a wish for a separate operating panel so that the table may be operated independently of the PC.

The object of the invention is to provide a simple operating panel which is easy to use and easy to mount.

SUMMARY OF THE INVENTION

The object is achieved according to the invention in that the hinge is formed with a rotary shaft on one part and a bearing with a cylindrical face on the other part, said hinge being formed with retaining means such that the keyboard part may assume various angular positions relative to the mounting part, said retaining means exerting a retaining force in the hinge which is greater than the necessary operative pressure on the operating keys, but smaller than the force necessary to move the keyboard part manually between the various angular positions. The keyboard part may thus be adjusted to an angular position convenient to the user, while the part yields to unintentional impacts and blows. In this respect, it is expedient to make at least one end, preferably both ends, of the keyboard part, inclined or curved, whereby the keyboard part rotates away more easily when it hits an obstacle with this edge.

The retaining means of the hinge may be formed as interengaging projections and depressions on the rotary shaft and the cylindrical face in the bearing for the shaft, respectively, which gives a stepwise adjustment of the keyboard part. In a preferred embodiment, the retaining means are formed by one or more O-rings of rubber or a corresponding material interposed between the rotary shaft and the cylindrical face in the bearing for the shaft. This gives a stepless adjustment of the keyboard part. The O-ring is embedded either in a groove in the shaft or in the cylindrical face. U.S. Pat. No. 6,249,426 B1 uses a hinge with O-rings to retain the screen of a portable computer, while the keyboard is arranged on a fixed substrate. Of course, there are other means for generating the retaining force, it being thus possible to use frictional coatings on the surface. The retaining force may also be generated by means acting on end faces of the hinge.

The advantages of the invention defined in the additional dependent claims will become apparent from the following, just as further features of the invention will be discussed.

The invention will be explained more fully below with reference to the embodiment of an operating panel particularly intended for a height-adjustable work table, which is shown in the accompanying drawings.

Figure 2:
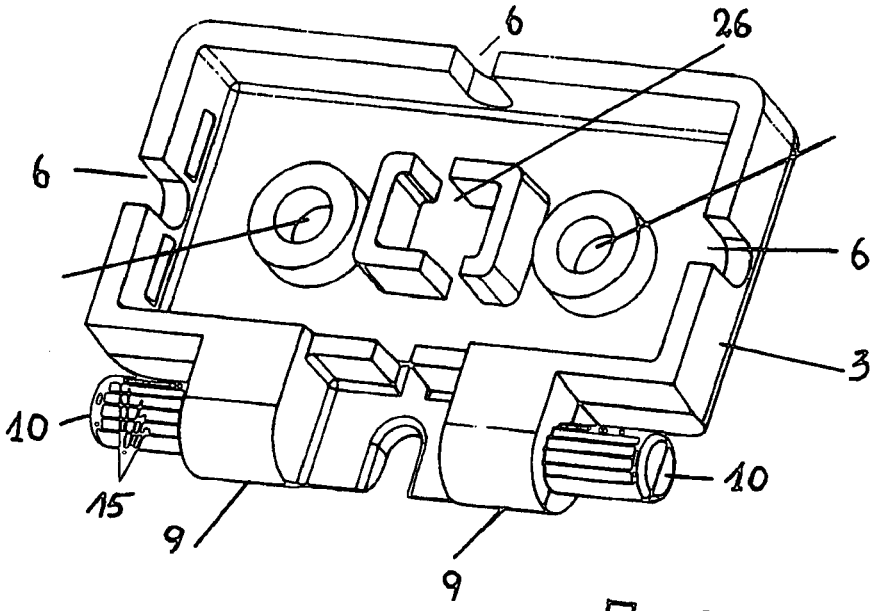
Figure 3:
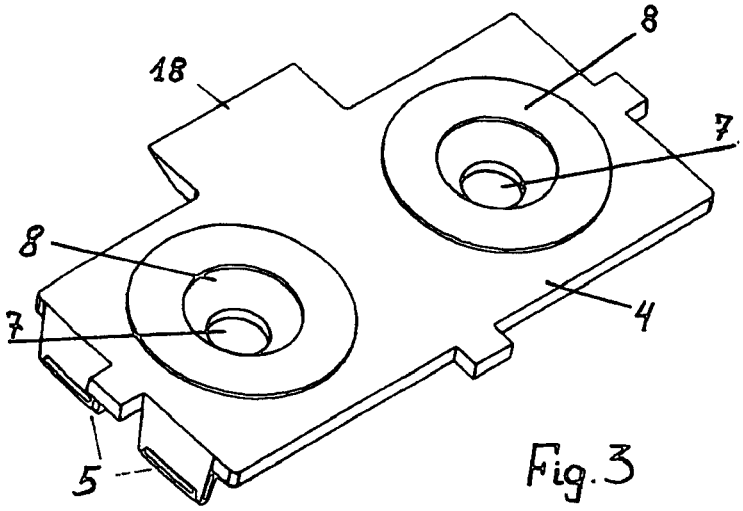
Figure 4:
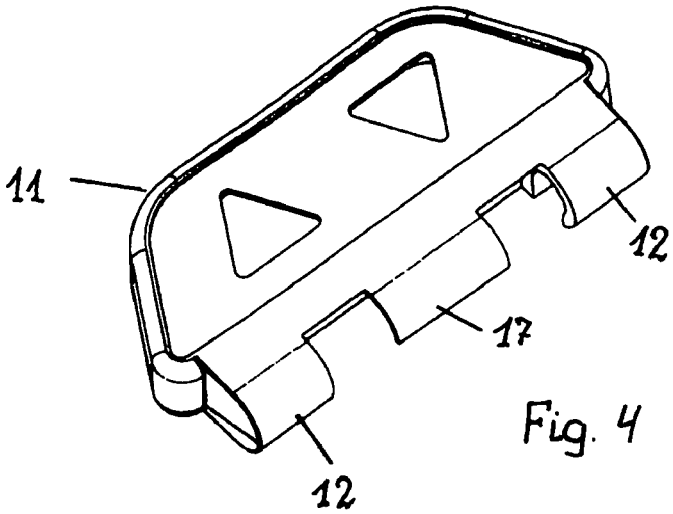
Figure 5:
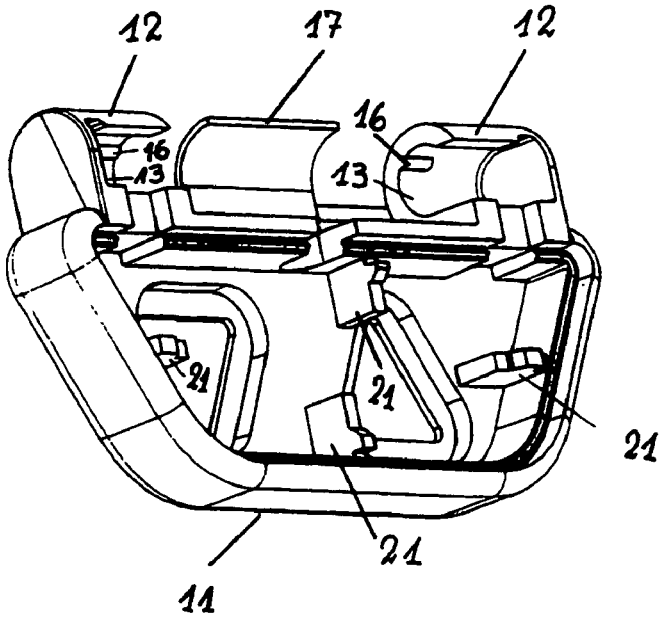
Figure 6:
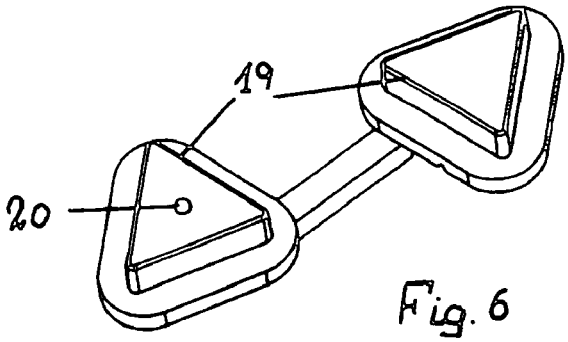
Figure 7:
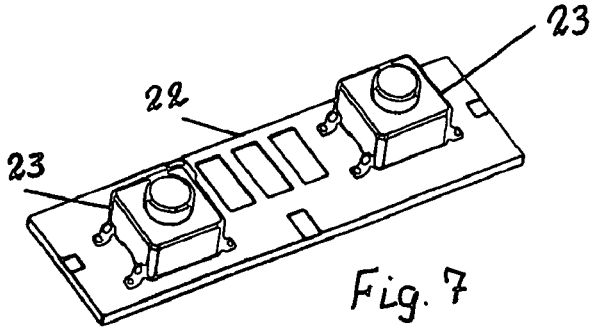
Figure 8:
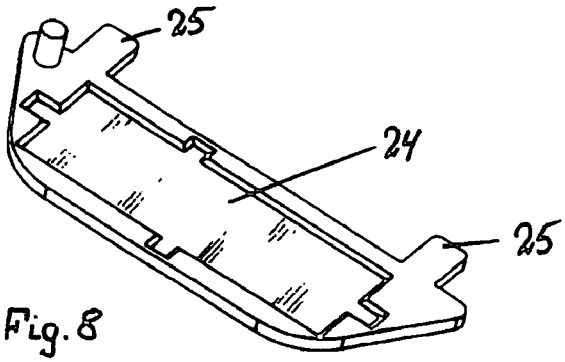
Figure 9:
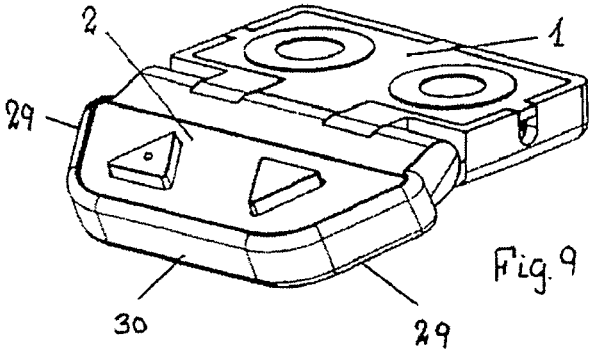
Figure 14:
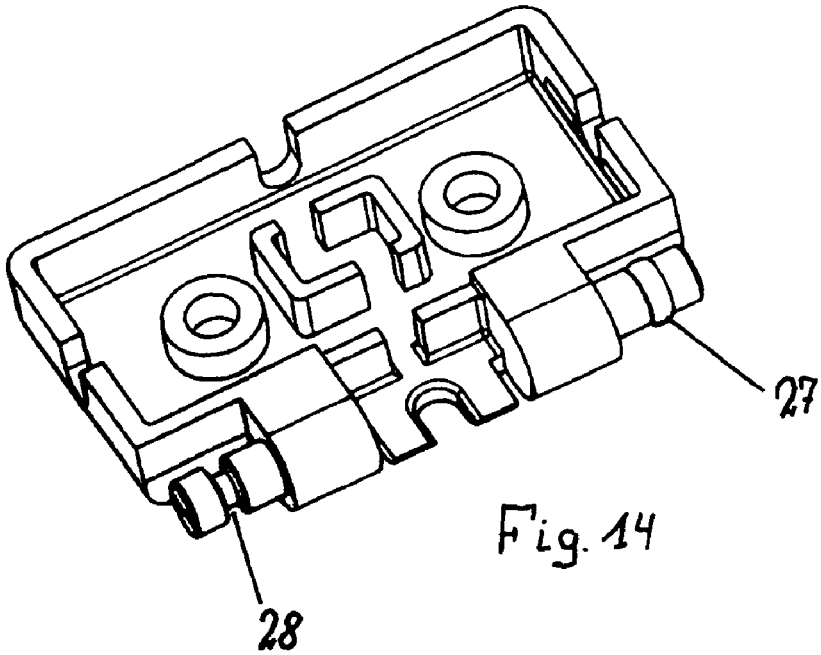

FIG. 1 shows an operating panel seen from above,

FIG. 2 shows a box-shaped part for the mounting part of the operating panel, FIG. 3 shows a cover for the parts shown FIG. 2, FIG. 4 shows a housing seen from above for the operating part of the operating panel, FIG. 5 shows the housing of FIG. 4, seen from the lower side, FIG. 6 shows a set of operating keys for the keyboard part, FIG. 7 shows a printed circuit board for the keyboard part, FIG. 8 shows a cover plate for the keyboard part, FIGS. 9 to 13 show various positions of the keyboard part, and FIG. 14 shows a box-shaped part for the mounting part of the operating panel similar to that shown in FIG. 2, but constructed for O-rings as retaining means.

DETAILED DESCRIPTION OF THE PREFERRED EMBODIMENTS

The operating panel comprises a mounting part 1, called mounting part intended for mounting on the table in the following, and a keyboard part 2, called the keyboard part in the following. The mounting part 1 consists of a flat box 3 which may be closed by a cover 4 retained by snap locks on legs 5. A recess 6 is formed in the three sides for selective guidance of a cable which is passed through a tensile relief 26 consisting of a square tower having two openings which are mutually offset and through which the cable is inserted. Two screw holes 7, defined by a ring wall, extend through the box, said screw holes terminating on the lower side of the box as well as on the upper side of the cover 4 in a countersink 8 for a screw head.

One long side of the box 3 has two protruding brackets 9 which are cylindrically rounded forwardly. On the sides of the brackets facing away from each other there is a stub shaft 10, and these two together form a rotary shaft for the keyboard part 2.

The keyboard part 2 comprises a housing 11 which, in outline, essentially appears as an isosceles trapezium. A bearing housing 12 is arranged at the ends of the long side, said bearing housing having a cylindrical face 13 which corresponds to the stub shaft 10. The bearing housing 12 has an opening sufficiently large for the stub shaft 10 to be just pressed through it. The stub shaft 10 is formed with depressions in the form of closely spaced grooves 15, and the cylindrical face of the bearing housing is formed with a projection in the form of a rib 16 which fits the grooves 15.

The keyboard part 2 is secured to the mounting part 1 by clicking the stub shafts 10 down into the respective bearing housings 12. For additional fixing, the housing 11 of the keyboard part has a curved flap 17 which acts against a flap 18 on the cover 4 of the mounting part when this is snapped firmly on to the housing of the mounting part.

A set of operating keys 19 may be inserted into the cavity in the housing 11 of the keyboard part, said operating keys protruding through recesses, designed for the purpose, in the upper side of the housing. One operating key is formed with a knob 20 on the upper side for recognition with the finger tips. A printed circuit board 22 is arranged on carrier bosses 23 in the housing, having two switches 23 located below the operating keys 19. Finally, the housing is closed with a bottom plate 24, which holds the printed circuit board and thereby the operating panel in position. The bottom plate 24 moreover has two arms 25 which, through notches, protrude inwards over the entry openings to the bearing housings in order to additionally protect the stub shafts from dropping out.

A wire (not shown) from the printed circuit board runs through an opening into the mounting part.

The keyboard part 2 may be set with the fingers in various angular positions relative to the mounting part, as shown in FIGS. 9 to 13, determined by the number and the position of the groove-shaped depressions 15. The holding force between the depressions 15 and the two strip-shaped projections 16 is adjusted such that the keyboard part maintains its position when the keys 19 are operated.

FIG. 14 shows another embodiment, where the retaining force is generated by O-rings 27 of rubber or rubber-like plastics embedded in grooves 28 in the stub shafts 10. One shaft stub is provided with an O-ring, the other with a groove for the O-ring. The bearing housing 12 for the stub shafts is formed for cooperation with the O-rings, which just rise above the surface of the stub shafts and slide against the cylindrical face 13, cf. FIG. 5, where the strip-shaped projection 16 is now omitted.

Figure 10:
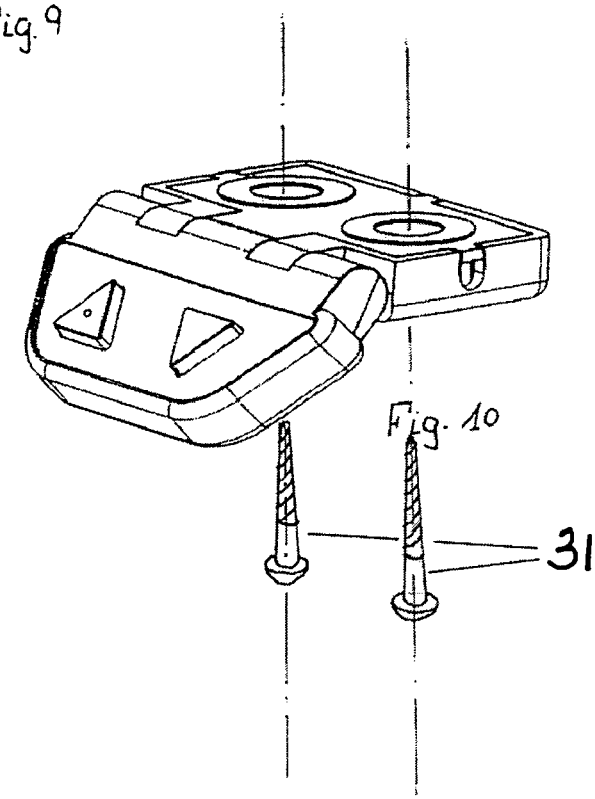

The operating panel may be mounted below a table with attachment means in the form of two screws 31 from the lower side of the mounting part 1 and with the keyboard part 2 protruding forwardly of the edge of the table (see FIG. 10). Here, the keyboard part 2 may be set in a various positions, e.g., straight out from the table, in several different inclined angles or vertically down from the tabletop where the keyboard part 2 is seated completely below the tabletop.

In case of collision with the operating panel, e.g. during movement of the table, the keyboard part rotates down to a vertical position. The inclined or wedge-shaped end faces 29 promote this movement, since the collision generates a power component which actively rotates the keyboard part. The collision need not be very great before the keyboard part yields, viz. corresponding to the force to be applied in order to move the keyboard part between the various positions.

It should be noted that the mounting part may also be mounted with the keys facing upwards, and if desired completely concealed below the tabletop.

The invention thus provides an operating panel which is simple and easy to mount. The users can easily set the keyboard part in the desired angular position, their functions may readily be recognized with the knob on the one key. The panel is simple to mount, and the wire may readily be run in the correct direction.

Figure 11:
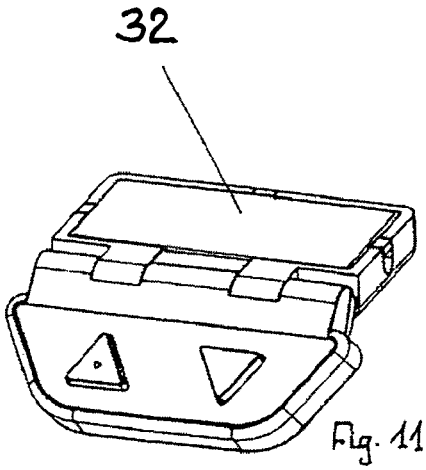
Figure 12:
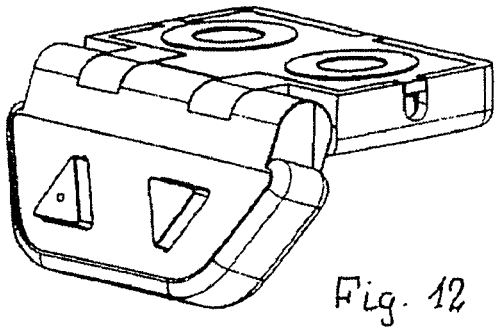
Figure 13:
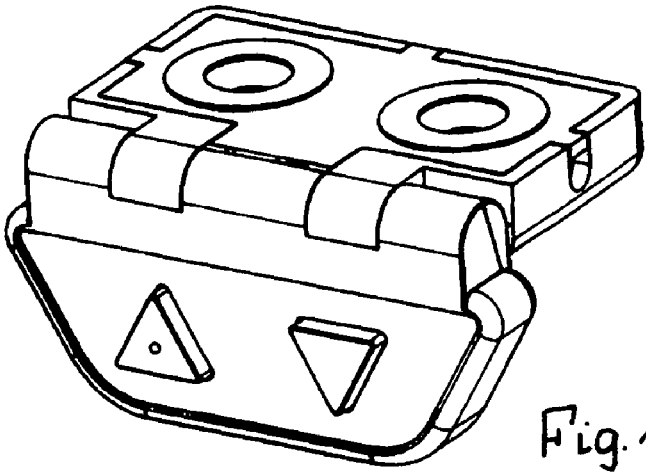

It will be appreciated that the operating panel may be mounted in another manner than with screws, a simple alternative being a self-adhesive tape 32 (see FIG. 11). It is likewise evident that the operating panel may be equipped with more than two operating keys or just with a single one, just as the operating keys and the switches may be of another structure than those shown here, it being possible, e.g., to use switches with integrated operating keys or sheet keys of their own. The keyboard part may, of course, also be provided with a display for showing various items of information, e.g., height, user codes, etc.

It will readily be appreciated that the groove-shaped depressions and the strip-shaped projection may be provided on the opposite parts, i.e. in the bearing housing and on the stub shafts, respectively. It will moreover be appreciated that the depressions and the projections do not necessarily have to be in the shape shown in the drawing. The depressions might e.g. have the shape of a ball face and the projections correspondingly, just as there might be more projections in engagement with depressions at the same time and not just one projection in engagement with a depression.

In the embodiment shown in the drawing, the rotary shaft is formed by two stub shafts, but it will be appreciated that it may also be constructed as a single through-going shaft, or with a shorter shaft at the centre. Although the invention has been described here especially in connection with height-adjustable tables, it will be appreciated that the operating panel may of course be used in connection with other forms of furniture. It is contemplated that the operating panel is mounted such that the rotary shaft is horizontal, but it will be appreciated that it may of course also be mounted with the rotary shaft in a vertical position.

The invention claimed is:

1. An electrical operating panel which comprises:

a mounting part and means for fixedly attaching the mounting part to a support structure;

a keyboard part having a front side and a rear side and at least one manually-operable operating key exposed on said front side for activating electrical switches, and hinge means for adjustably connecting said keyboard part to said mounting part at various angular positions, said hinge means including a rotary shaft connected to a first of said mounting part and said keyboard part and a bearing connected to a second of said mounting part and said keyboard part, said bearing providing a cylindrical inner wall for positioning around said rotary shaft to enable rotational movement between said shaft and said bearing, and retaining means for resisting rotational movement between said rotary shaft and said bearing with pressing of said at least one operating key.

2. The electrical operating panel according to claim 1, wherein at least one end of the keyboard part is inclined or curve-shaped inwards toward a centre of a free edge of a keyboard part.

3. The electrical operating panel according to claim 1, wherein the retaining means comprise at least one projection which interengages with depressions.

4. The electrical operating panel according to claim 3, wherein the depressions are formed in the bearing, and the at least one projection is formed on the rotary shaft.

5. The electrical operating panel according to claim 4, wherein the depressions are groove-shaped, and each projection is strip-shaped.

6. The electrical operating panel according to claim 1, wherein the retaining means comprise one or more O-rings disposed between the rotary shaft and the cylindrical inner wall of the bearing.

7. The electrical operating panel according to claim 1, wherein the rotary shaft comprises two stub shafts.

8. The electrical operating panel according to claim 1, wherein the mounting part consists of a flat box with a cover, and wherein said box includes a respective recess in three sides for selective guidance of a cable.

9. The electrical operating panel according to claim 8, including at least one screw hole that extends through the box and terminates on a lower side of the box as well on an upper side of the cover in a countersink for a screw head.

10. The electrical operating panel according to claim 8, wherein the mounting part includes a tensile relief for the cable at a bottom thereof.

11. The electrical operating panel according to claim 1, wherein the keyboard part comprises a housing which, in outline, essentially appears as an isosceles trapezium, with a longest side facing inwards toward the mounting part.

12. The electrical operating panel according to claim 1, wherein the bearing has an opening sufficiently large for the shaft to be pressed inwards therethrough in a snap-like manner.

13. The electrical operating panel according to claim 1, wherein the keyboard part has a curved flap which acts against a flap on the mounting part for additional fixing of the rotary shaft.

14. The electrical operating panel according to claim 1, wherein the keyboard part has two arms which, through notches, protrude inwards over entry opening(s) to the bearing to secure the rotary shaft.

15. The operating panel according to claim 1, wherein said means for fixing the mounting part to a support structure comprises at least one screw.

16. The operating panel according to claim 1, wherein said means for fixing the mounting part to a support structure comprises self-adhesive tape.

17. An article of furniture which includes an electrical operating panel according to claim 1.

* * * * *